US005213276A

United States Patent [19]

Weeks et al.

[11] Patent Number: 5,213,276

[45] Date of Patent: May 25, 1993

[54] SELF-THREADING JOURNAL PRINTER

[75] Inventors: David E. Weeks, Candor; Robert L. Wirth, Ithaca, both of N.Y.; Kenneth W. Hanna, Port Charlotte, Fla.

[73] Assignee: NCR Corporation, Dayton, Ohio

[21] Appl. No.: 706,430

[22] Filed: May 28, 1991

[51] Int. Cl.[5] ..... B65H 20/04

[52] U.S. Cl. ..... 242/67.30 R; 226/91

[58] Field of Search ..... 242/67.3 R, 68.7, 67.1 R, 242/67.2; 226/91; 400/595, 605, 607, 613.1; 101/92, 288

[56] References Cited

U.S. PATENT DOCUMENTS

| | | | |
|---|---|---|---|
| 2,337,270 | 12/1943 | Racz | 197/132 |
| 3,576,283 | 4/1971 | MacDonald, Jr. | 226/91 X |
| 3,827,544 | 8/1974 | Smith | 197/133 R |
| 3,857,527 | 12/1974 | Kranz | 242/67.3 RX |
| 4,059,211 | 11/1977 | Brizzolara | 226/91 X |
| 4,264,218 | 4/1981 | Okabe et al. | 400/605 X |
| 4,453,842 | 6/1984 | Archer et al. | 400/605 |
| 4,826,336 | 5/1989 | Kamimura et al. | 400/607 |
| 4,875,634 | 10/1989 | Lapadakis | 242/67.3 R |
| 4,971,469 | 11/1990 | Nakajima | 400/636.1 |

*Primary Examiner*—Daniel P. Stodola
*Assistant Examiner*—John P. Darling
*Attorney, Agent, or Firm*—Joseph G. Nauman

[57] ABSTRACT

A self-threading and feeding arrangement for a printer including a drop-in supply station, a printing station and a take-up station. A pay-out roller is journaled across the bottom arcuate wall of the supply station for supporting a web of print receiving media placed therein. A take-up spool includes a retainer for interengaging with a lead of the media web to positively draw the web around the rotated spool. The take-up station also includes a slot-like exit guide chute that has a contoured tip for cooperating with the retainer on the take-up spool, during loading of a new roll, to place the web lead into engagement with the retainer. A drive roller, and preferably the pay-out roller, are driven by a first stepping motor, and the take-up spool is driven by a separately actuable second stepping motor.

8 Claims, 7 Drawing Sheets

FIG. 7A
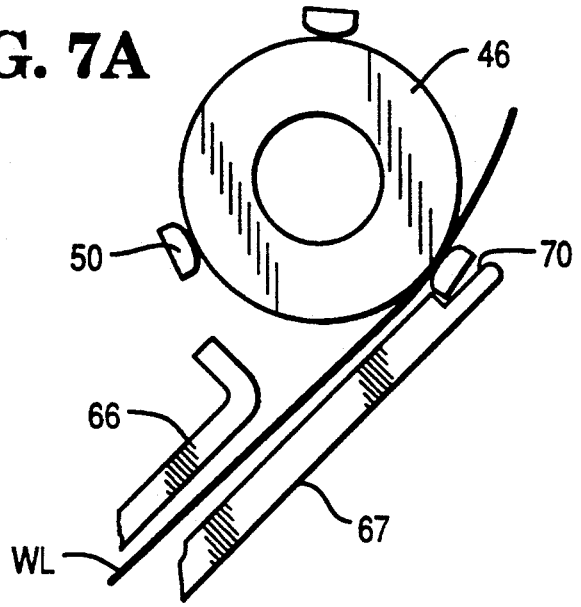
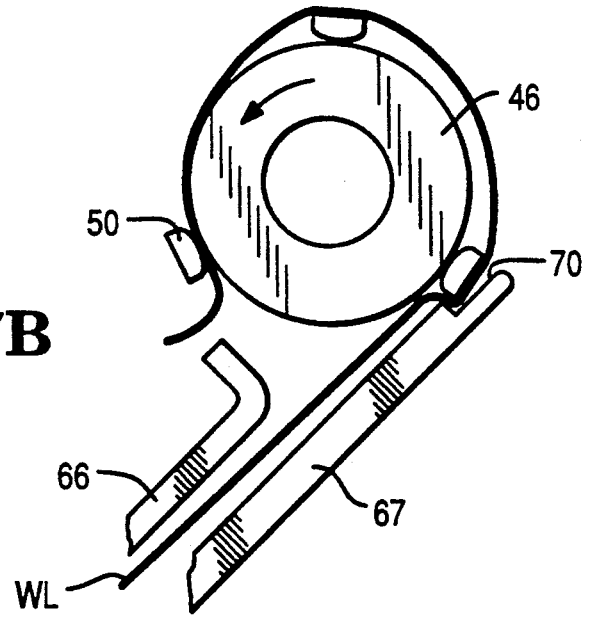
FIG. 7B
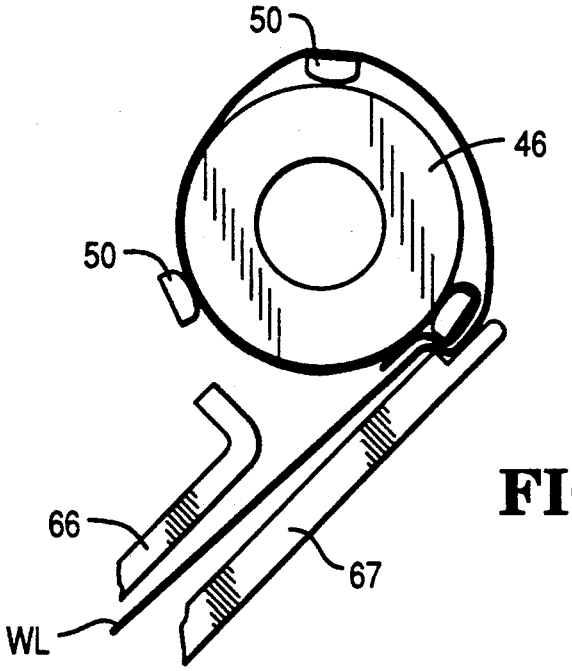
FIG. 7C

SELF-THREADING JOURNAL PRINTER

BACKGROUND OF THE INVENTION

This invention relates to printers, particularly so-called journal printers (or the like) on which a printing head has a web of print receiving media, usually paper, conveyed past the printing head from a supply roll of the media to a take-up spool. While such supply roll may be quite long to minimize printer down-time for loading fresh media and removing the printed web, considerable time is still required for loading a new roll and threading a leader through the printing head to the take-up spool. Such printers are often used in installations where there is urgency for a relatively unskilled operator to make the media change with dispatch and continue the primary task, for example at the check-out counter of a supermarket.

Thus, there is a need for simple, reliable, easy to use self-threading apparatus for printers of this type. Furthermore, the same principles apply to various other small printers using continuous feed from a supply of print receiving media to a roll take-up of some sort.

SUMMARY OF THE INVENTION

The present invention provides in a journal printer or the like, a novel self-threading and feeding arrangement for the print receiving media, usually a rolled web of paper. While the printer structure may be incorporated into various environments, and may be part of a larger apparatus, the basic printer structure can be characterized as including three stations, arranged seriatim, namely a supply station, a printing station, and a take-up station.

The supply station receives and supports a fresh roll of the printing receiving media web, and preferably is of a simple drop-in design. The operator has merely to set a fresh roll into the supply station, with a central spool in the roll having extending shaft ends received into parallel guide slots formed in opposed walls of the supply station. The bottom of the roll rests on or adjacent an arcuate bottom wall, preferably upon a pay-out roller which is journalled across an edge of the bottom wall. As the media is used, and the supply roll decreases, its spool drops along these slots. Thus, the weight of a full roll, when first loaded, holds it against the pay-out roller.

Extending away from the pay-out roller and toward the printing station is an entrance guide means, in the form of vertically spaced upper and lower plate-like parts which define an entrance chute through which the media web is guided. This entrance chute has a beginning near the pay-out roller, and ends adjacent a print head supported in the printing station. Initially, during loading of media, a leader of media web is pushed through this entrance chute to the printing station.

At the printing station there is a conventional print head, for example a line impact printer head and corresponding anvil spaced therefrom, defining a path through the printing station where the media web is imprinted with data in successive transverse bands.

The take-up station includes a power driven take-up spool which is rotatably supported, spaced from the printing station, allowing room to accommodate a growing roll of printed media web gathering around the take-up spool. Preferably, the rotational axis of the take-up spool is fixed, and the spool includes a retainer means for interengaging with a lead of the media web t positively draw the web around the rotated spool. The take-up station also includes an exit guide means for the media web departing the printing station and moving to the take-up spool.

A feed roller with a cylindrical friction surface, and an opposed cooperating pressure roller, are mounted at the beginning of the exit guide means, adjacent the printing station, and the web is received between these rollers and traction fed, usually in stepped manner, toward the take-up spool. The exit guides means comprises a slot-like chute formed by a pair of closely spaced plate-like members, and having a pivot support which is adjacent, preferably coincident with, the feed roller at the entry to this exit chute. The other or exit end of this chute is located at the take-up spool, and thus can move in an arc toward and away from that spool as the media web builds thereon. The exit chute has a contoured tip which cooperates with the retainer means on the take-up spool to place the lead of the web, during loading of a new roll, into engagement with the retainer means on the take-up spool.

The drive roller and preferably the pay-out roller, are driven by a first motor means, preferably a stepping motor, and the take-up spool is driven by a separately actuatable second motor means, preferably a second stepping motor. A control is provided which, upon placing a fresh roll of media web in the supply station, causes pay-out of a lead of the web through the printing station and along the exit chute to the retainer means on the take-up spool. There, the end of the lead fits into the retainer means and the take-up spool is then rotated a few times to secure the lead of the web onto the take-up. The printer is then ready for use.

The principal object of this invention is to provide a novel self-threading arrangement for a journal type printer or the like; to provide such a printer into which a fresh roll of print receiving media can be placed, after which the printer self-threading mechanism forms a lead on the free end of the media and threads that lead past the printing head and onto a takeup spool, after which the takeup spool is actuated sufficiently to engage the lead thereto; to provide a novel swinging guide for the lead to direct it into engagement with the takeup spool, and to continue to guide the lead onto the periphery of the takeup of roll as it enlarges during printer operation.

Other objects and advantages of the invention will be apparent from the following description, the accompanying drawings and the appended claims.

BRIEF DESCRIPTION OF THE DRAWINGS

FIGS. 7A, 7B and 7C are views similar to FIG. 6, illustrating the progressive engagement of a web lead with the take-up retainer.

DESCRIPTION OF THE PREFERRED EMBODIMENT

Figure 1:
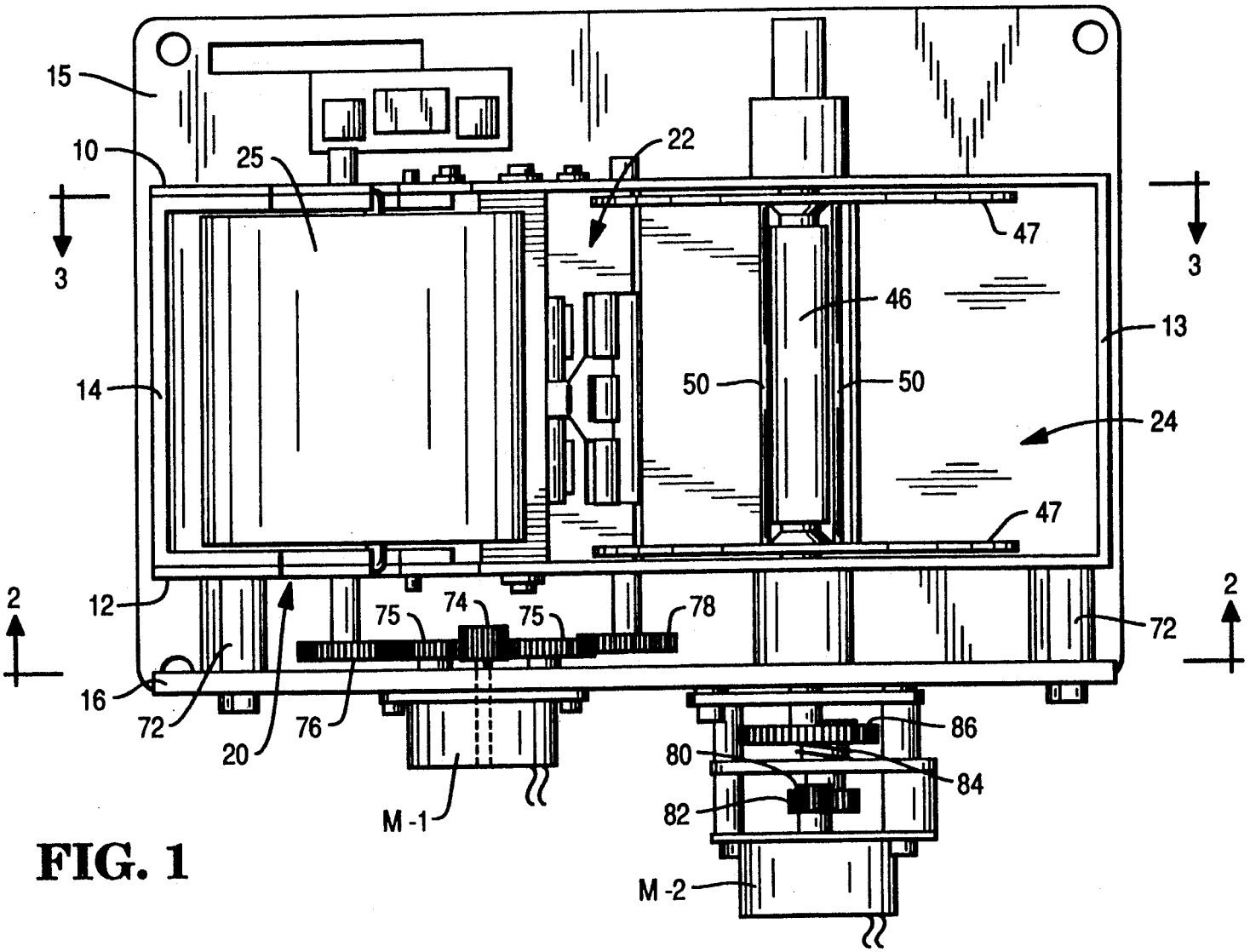
FIG. 1 is a plan view of the invention incorporated into a journal printer.
Figure 2:
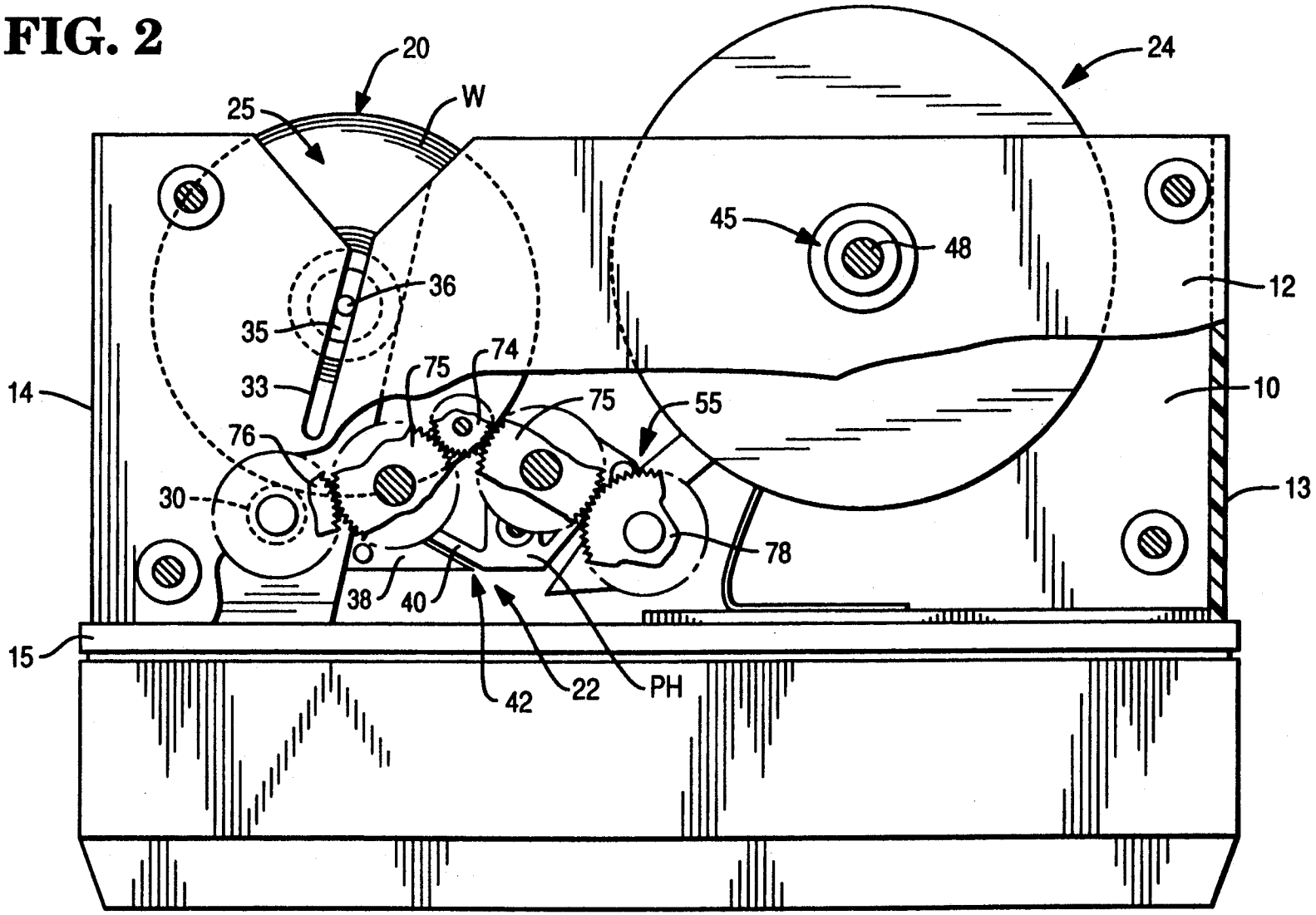
FIG. 2 is a longitudinal cross-section view, with some parts broken away for illustration, taken along line 2—2 on FIG. 1.
Figure 3:
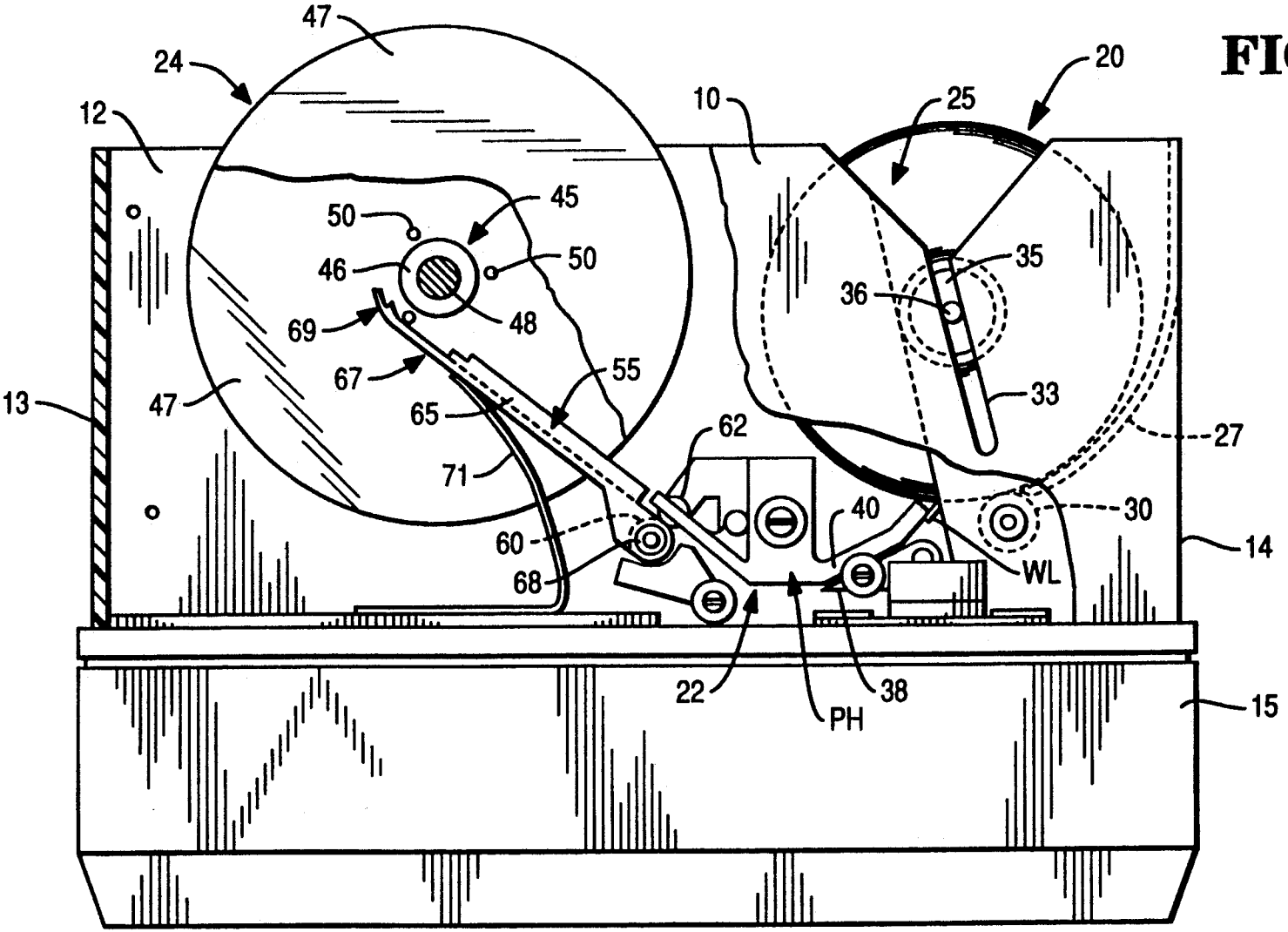
FIG. 3 is a view similar to FIG. 2, taken generally on line 3—3 on FIG. 1, with the orientation of the unit reversed.

Referring to the drawings, and initially to FIGS. 1, 2 and 3, for purposes of illustration and description the printer and its self-loading and self-threading features are shown as a stand-alone unit. However, it will be understood that the structure may be a part of a larger apparatus with common walls or partitions and with covers which are omitted for clarity and simplification of description.

The basic printer structure is defined by side walls 10 and 12, joined by end walls 13, 14, all extending from a base 15, and an outer side wall 16 which provides support for the drive devices as later described. These walls and the base define three stations, arranged seriatim, namely a supply station 20, a printing station 22, and a take-up station 24.

The supply station receives and supports a fresh roll 25 of the printing receiving media web W, and preferably is of a simple drop-in design. The supply station 20 is defined by an upper portion of end wall 14 and adjoining portions of walls 10 and 12, between which extends an arcuate wall 27. At the lower edge of wall 27 is a pay-out roller 30, having a cylindrical friction surface 32 (e.g. of rubber) which is tangent to a line extending along the arc of wall 27. The adjacent parts of side walls 10 and 12 have slots 33 formed therein, extending along a plane which intersects the axis of roller 30 and is approximately located on the arc center of wall 27.

Roll 25 is fitted with a pay-out spool 35 which extends through the core of the roll and includes end spindles 36 of a size to fit loosely in slots 33. Thus, a full roll 25 rests on roller 30 and as it is depleted, the pay-out spool descends slots 33. The weight of the roll, particularly a fresh roll, acts to hold it against the friction surface of roller 30.

Extending away from the pay-out roller and toward the printing station is an entrance guide means, in the form of vertically spaced upper and lower plate-like parts 38 and 40, which define an entrance chute 42 through which web W is guided. This entrance chute has a beginning near pay-out roller 30, and ends adjacent a print head PH supported in printing station 22. Initially, during loading of media, a leader WL of media web W is pushed through chute 42 to the printing station.

Print head PH is of any suitable conventional type, for example a line impact printer head and corresponding anvil (not shown) spaced therefrom, defining a path through the printing station where web W is imprinted with data.

The take-up station includes a power driven take-up spool 45 which is rotatably supported between side walls 10 and 12, spaced from printing station 22, allowing room to accommodate a growing roll of printed media web W gathering around the take-up spool. This spool includes a central cylindrical piece 46 carrying opposite side flanges 47, adapted to be removably connected to a take-up spool shaft 48 along a fixed axis of rotation between side walls 10 and 12. The support and drive for the take-up spool is conventional, and thus is not shown in detail. In general, it includes coaxial shafts (one of which is shaft 48) in the side walls and spring loaded toward each other and supported in the side walls 10 and 12. These have conical ends with at least one radially extending blade, and the central piece 46 has corresponding conical sockets at its ends which receive the ends of the coaxial shafts to support the take-up spool for rotation, and to provide a releasable drive connection to it. Numeral 48 designates the driven one of these coaxial shafts.

The spool 45 includes a retainer means in the form of a plurality of bars or rods 50 extending between flanges 47 in closely spaced relation to central piece 46. Thus, these bars define narrow slots 52 at intervals around the take-up spool, through which a lead WL can pass during initial threading of lead WL to take-up spool 45, and for interengaging the spool with lead WL to positively draw it therearound. Take-up station 24 also includes an exit guide means 55 for web W departing printing station 22, guiding the web to spool 45.

A feed roller 60 with a cylindrical friction surface, and an opposed cooperating pressure roller 62, are mounted at the beginning of the exit guide means, adjacent printing station 22 (see FIG. 3). Web W is received between rollers 60 and 62, and traction fed, usually in stepped manner, toward take-up spool 45. Exit guide means 55 comprises a slot-like chute 65 formed by a pair of closely spaced plate-like members 66 and 67, and having a pivot support 68 which is adjacent, preferably coincident with, feed roller 60 at the entry to chute 65. The other or exit end of chute 65 is located at take-up spool 45, and thus can move in an arc toward and away from that spool, as web W builds thereon. A leaf spring 71 acts against chute 65, urging it toward spool 45.

Figure 6:
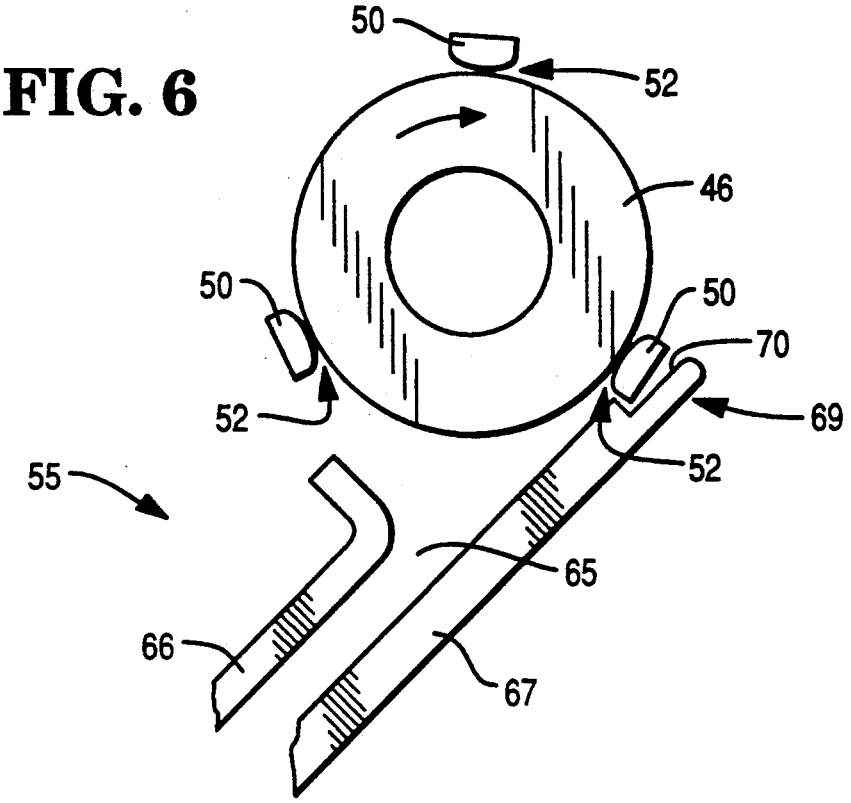
FIG. 6 is an enlarged detail view of the end of the exit chute and the retainer means on the take-up spool.

Exit chute 65 has a contoured tip 69, including an upward opening slot 70, which cooperates with the retainer bars 50 (see FIG. 6 and FIGS. 7A—7C) to guide lead WL, during loading of a new roll, through one of the slots 52. As shown in FIG. 6, one of the bars 50 rests in slot 70 at the start of the threading operation. Achieving this orientation is explained below.

Figure 4:
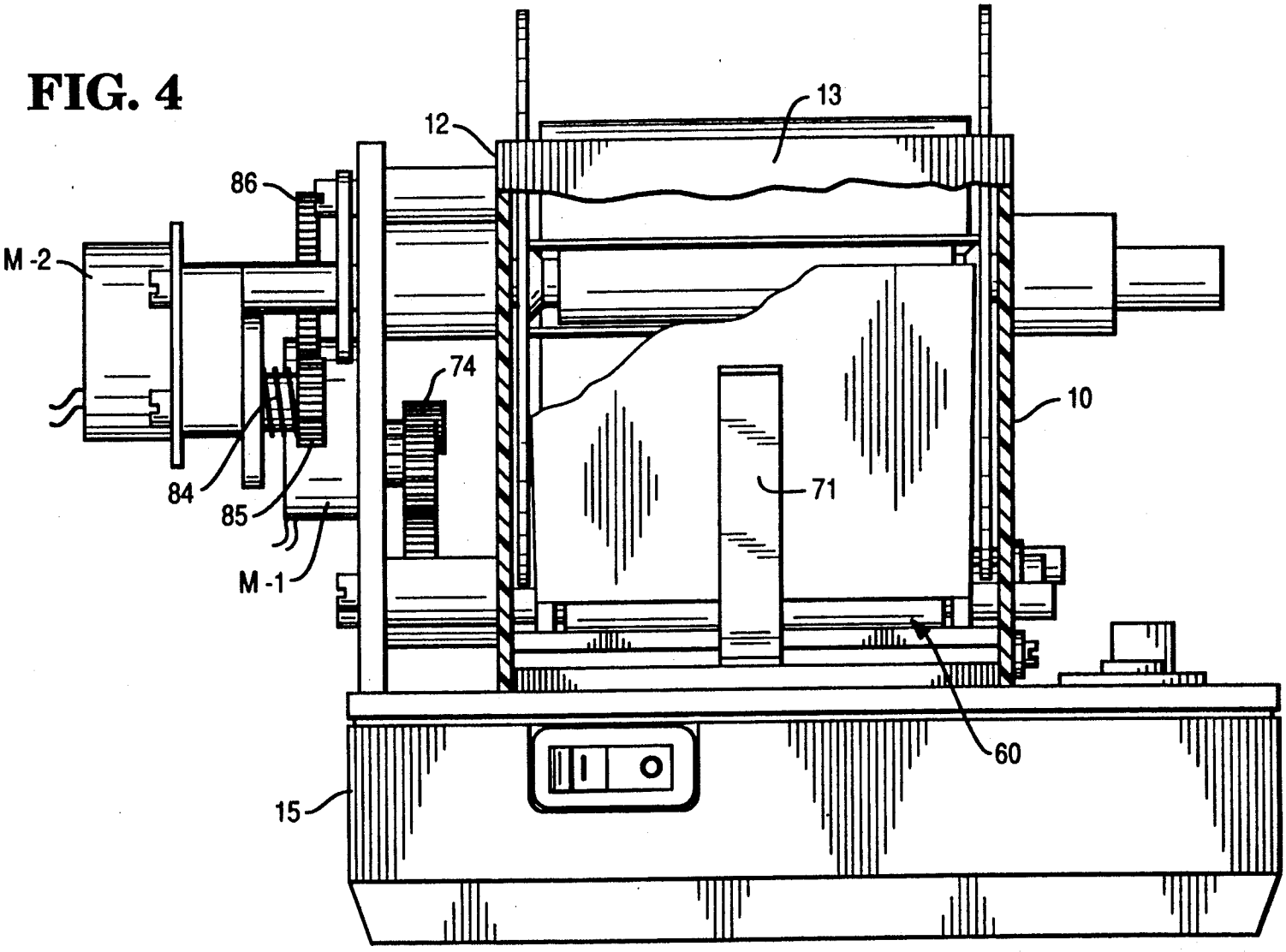
FIG. 4 is an end view from the right of FIG. 1.
Figure 5:
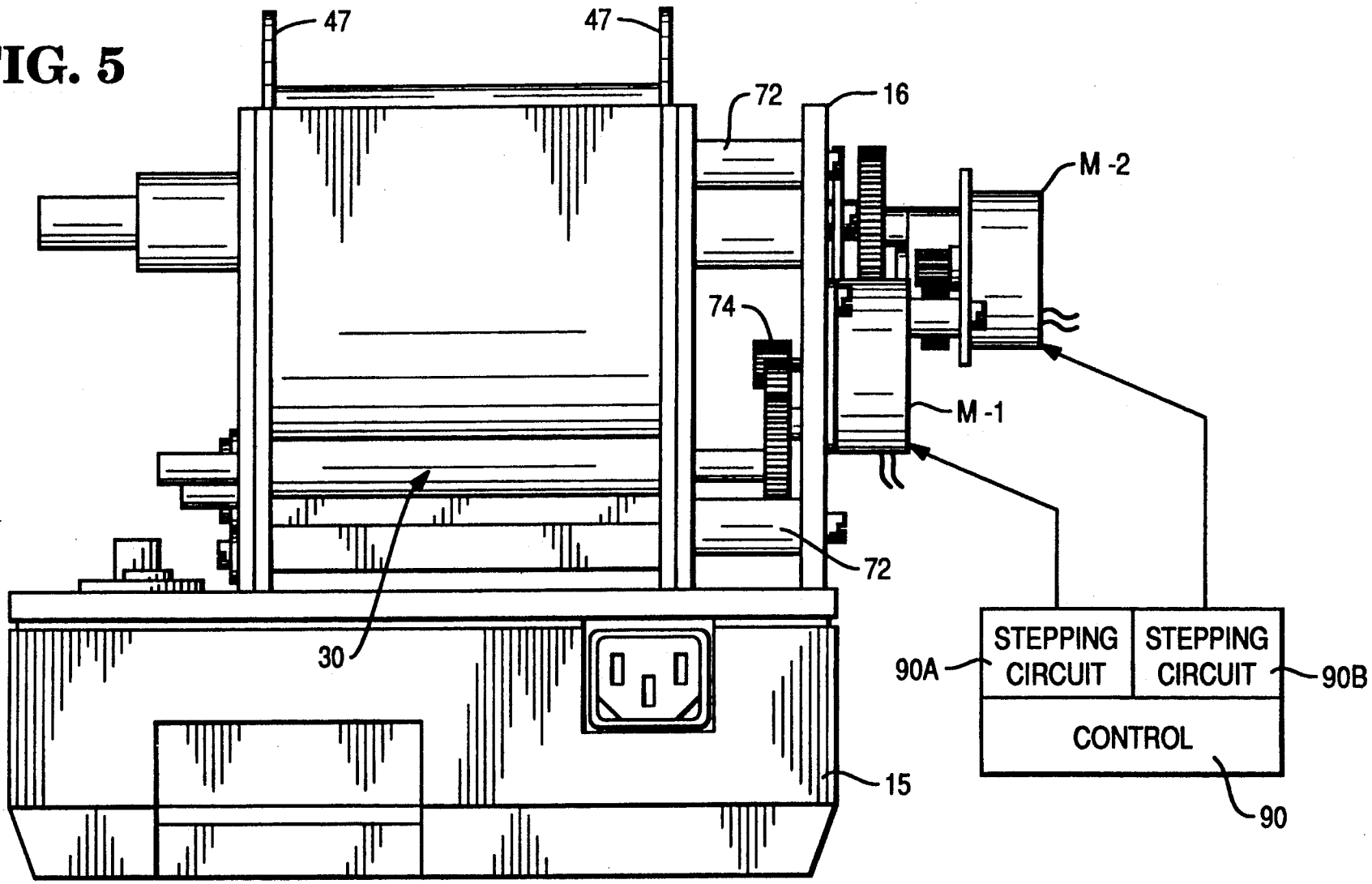
FIG. 5 is an end view from the left of FIG. 1, also including a block diagram of a control for the printer drive.

Feed drive roller 60, and preferably pay-out roller 30, are driven by a first motor means, preferably a stepping motor M1, and take-up spool 45 is driven by a separately actuatable second motor means, preferably a second stepping motor M2. As seen in FIGS. 1, 4 and 5, these motors are supported on outer wall 16 which is secured to side wall 12 by a set of standoffs 72. Motor M1 has a pinion 74 which is engaged with idler gears 75. These idlers in turn rotate drive gear 76 fastened to the shaft of pay-out roller 30, and drive gear 78 fastened to the shaft of drive roller 60. Thus, stepping pulses to motor M1 rotate the pay-out and drive roller in unison, to present a taut length of web W across the print station 22.

Motor M2 has an output pinion 80 meshing with the input gear 82 of a spring loaded slip clutch 84, and the clutch output gear 85 meshes with a driven gear 86 fixed to the take-up spool shaft 48. As shown diagrammatically in FIG. 5, a control 90 is provided which directs stepping pulses to motors M1 and M2. This control is of conventional design, and includes stepping circuits 90 A and 90 B connected to drive the stepping motors M1 and M2, respectively.

Upon placing an emptied take-up spool back in the printer, control 90 first causes motor M2 to rotate that spool in a clockwise direction (as viewed in FIG. 6) until a bar 50 engages into exit chute slot 70. This stops the motion of the spool, but the clutch 84 will slip to accommodate this action until motor M2 is stopped.

Then, after placing a fresh roll of media web in the supply station, the control is actuated to drive motor M1 to cause pay-out of a lead WL of the web through the printing station and along the exit chute 65 to its end or tip 69, which is pressed against take-up spool central piece 46. There, the end of the lead advances through and beyond one of retainer slots 52, after which the threading feed is halted. Both motors M1 and M2 are then rotated a few revolutions, and the lead WL is secured around the take-up spool, as shown in the steps illustrated in FIGS. 7A through 7C. The printer is then ready for use.

Figure 8:
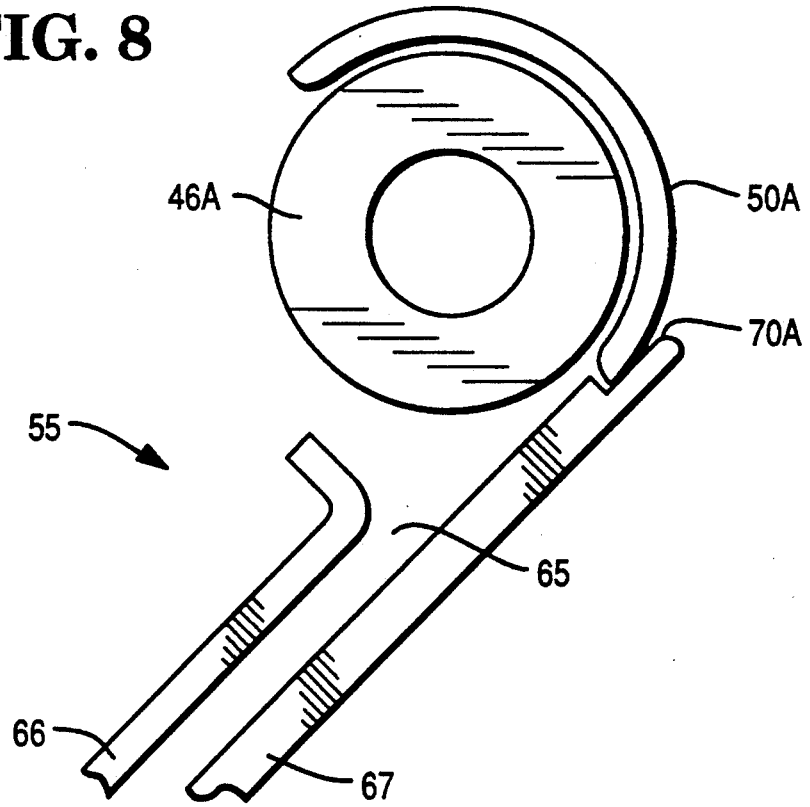
FIG. 8 is a view similar to FIG. 6, showing another form of web lead retainer on the take-up spool.

FIG. 8 shows a modified form of take-up retainer. Instead of the multiple bars 50, a semicircular wall 50A is formed around, and spaced from, take-up center piece 46A. The edge of wall 50A fits into the slot 70A at the end of the exit chute 65, and a lead WL is thus guided into the space between wall 50A and the central piece 46A.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. In a printer for printing successive lines on a web of print receiving material, a housing including spaced apart side walls defining between them a supply station, a printing station, and a take-up station, a supply cradle for a web of material, said cradle having an arcuate bottom wall extending between said side walls, means forming guide slots in said walls extending along a plane substantially coincident with a radius of said arcuate bottom wall to receive and to guide a supply spool fitted in a roll or print receiving material, an entrance guide extending along a tangent from said bottom wall, entrance guide means extending from said supply cradle to said printing station, a take-up spool supported on said side walls along a fixed axis extending across said take-up station, exit guide means extending from said printing station to said take-up spool, said exit guide means including a portion movable toward and away from said take-up spool, said guide means cooperating to define a path for a web of the print receiving material from said supply cradle to said take-up spool, a drive roller having a cylindrical friction surface supported on a traverse axis to said path with said friction surface tangent to said path, a pressure roller supported on the opposite side of said path from said drive roller, and bias means urging said pressure roller toward said drive roller, first motor means connected to rotate said drive roller, and second motor means independently operable from said first motor means and connected to rotate said take-up spool in a first direction to position said take-up spool for engagement with the web of print receiving material, and in a second direction for taking up the web of print receiving material once engaged.

2. In a printer for printing successive lines on a web of print receiving material, a housing including spaced apart side walls defining between them a supply station, a printing station, and a take-up station, a supply cradle for a web of material, said cradle having an arcuate bottom wall extending between said side walls, means forming guide slots in said walls extending along a plane substantially coincident with a radius of said arcuate bottom wall to receive and to guide a supply spool fitted in a roll or print receiving material, an entrance guide extending along a tangent from said bottom wall, entrance guide means extending from said supply cradle to said printing station, a take-up spool supported on said side walls along a fixed axis extending across said take-up station, exit guide means extending from said printing station to said take-up spool, said exit guide means including a portion movable toward and away from said take-up spool, said guide means cooperating to define a path for a web of the print receiving material from said supply cradle to said take-up spool, a drive roller having a cylindrical friction surface supported on a traverse axis to said path with said friction surface tangent to said path, a pressure roller supported on the opposite side of said path from said drive roller, and bias means urging said pressure roller toward said drive roller, first motor means connected to rotate said drive roller, second motor means independently operable from said first motor means and connected to rotate said take-up spool, a pay-out roller supported on an axis traverse to said bottom wall, said pay-out roller having a cylindrical friction surface intersecting said arcuate bottom wall to support the bottom of a roll of media contained in said supply station, and means for driving said pay-out roller from said first motor means.

3. Apparatus providing a self-loading feature in a journal printer or the like which uses a roll of print receiving media, comprising:

a housing including means defining a supply station and a take-up station spaced from each other, means defining a path of travel for a web of the print receiving media from said supply station to said take-up station, means defining a printing station along said path between said supply and take-up stations, means at said supply station for receiving a supply of the print receiving media, means providing an entrance guide for media from the supply thereof in said supply station and extending to said printing station, means including a first motor means for withdrawing the media from the supply in said supply station and feeding the media through said printing station, a take-up spool and means rotatably supporting said take-up spool at said take-up station, second motor means independently operable from said first motor means and connected for rotating said take-up spool in a first and second direction, said take-up spool being rotated in said first direction to position said take-up spool for engagement with a lead of the media, and said take-up spool being rotated in said second direction to take up the media once engaged, means providing an exit guide from said printing station to said take-up spool, and control means for selectively powering said first motor means to advance the lead of the media from the supply station through said entrance and exit guide means and into engagement with said take-up spool and for powering said second motor means to engage the lead of the media with said take-up spool.

4. Apparatus as defined in claim 3, wherein said exit guide has an end interacting with said take-up spool, means supporting said exit guide for movement of said end thereof toward and away from said take-up spool, means urging said end of said exit guide toward said take-up spool to present a lead from a new supply into engagement with said take-up spool.

5. Apparatus as defined in claim 4, wherein said take-up spool has a central piece and a lead engaging bar extending parallel to and closely spaced from said central piece to define a slot through which a lead can be passed.

6. Apparatus as defined in claim 5, wherein said end of said exit guide includes a slot opening toward said take-up spool and adapted to receive said bar, whereby a lead threaded through said exit guide is directed into and through said slot.

7. In a self-threading journal printer including a supply spool, a printing station, a take-up spool, and an exit guide, said exit guide disposed between said printing station and said take-up spool for directing a web of print receiving material from said printing station to said take-up spool, said take-up spool having a lead engaging bar which cooperates with said take-up spool to define a slot for retaining a lead of said print receiving material, said exit guide including a contoured tip having an inwardly opening slot for cooperating with said lead engaging bar, a method for self-threading said journal printer comprising the steps of:

driving said take-up spool in a first direction until said lead engaging bar engages with said upwardly opening slot of said exit guide, independently driving said lead of print receiving material from said supply spool through said printing station and said exit guide until said lead has engaged with said slot, and independently driving said take-up spool and said supply spool in a second direction for securing said lead of print receiving material to said take-up spool after said lead has engaged with said lead engaging bar.

8. A self-threading journal printer, comprising:

a printing station for printing successive lines on a web of print receiving material;

a take-up spool spaced apart from said printing station for receiving said web of print receiving material, said take-up spool including a central piece and a lead engaging bar extending parallel to and closely spaced from said central piece to define a slot through which a lead of said web can be passed;

an exit guide disposed between said printing station and said take-up spool for directing said web of print receiving material from said printing station to said take-up spool, said exit guide including a contoured tip having an upwardly opening slot for cooperating with said lead engaging bar whereby said lead is directed from said exit guide into and through said slot;

a supply cradle for supplying said web of print receiving material to said printing station, said supply cradle having an arcuate bottom wall; and a pay-out roller supported on an X-axis transverse to said bottom wall, said pay-out roller having a cylindrical friction surface intersecting said arcuate bottom wall to support the bottom of said web of print receiving material contained in said supply cradle;

said take-up spool being driven by a first motor means in a first direction until said lead engaging bar engages with said upwardly opening slot, said motor means then driving said take-up spool in a second direction once said lead has been directed into and through said slot, said pay-out roller being driven by a second motor means.

* * * * *

UNITED STATES PATENT AND TRADEMARK OFFICE

CERTIFICATE OF CORRECTION

PATENT NO. : 5,213,276

DATED : May 25, 1993

INVENTOR(S) : David E. Weeks et al.

It is certified that error appears in the above-identified patent and that said Letters Patent is hereby corrected as shown below:

Column 5, line 40, change "or" to --of--.

Signed and Sealed this

Fifth Day of April, 1994

Bruce Lehman

*Attest:*

BRUCE LEHMAN

*Attesting Officer*

*Commissioner of Patents and Trademarks*